US010670982B2

(12) United States Patent
Yamashita et al.

(10) Patent No.: US 10,670,982 B2
(45) Date of Patent: Jun. 2, 2020

(54) ELECTROSTATIC-IMAGE DEVELOPING TONER, ELECTROSTATIC IMAGE DEVELOPER, AND TONER CARTRIDGE

(71) Applicant: FUJI XEROX CO., LTD., Tokyo (JP)

(72) Inventors: Takahiro Yamashita, Kanagawa (JP); Kazuya Mori, Kanagawa (JP); Yuta Saeki, Kanagawa (JP); Takahisa Tatekawa, Kanagawa (JP); Akitsugu Seto, Kanagawa (JP); Yuji Isshiki, Kanagawa (JP); Takashi Hara, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 16/109,779

(22) Filed: Aug. 23, 2018

(65) Prior Publication Data

US 2019/0258186 A1 Aug. 22, 2019

(30) Foreign Application Priority Data

Feb. 21, 2018 (JP) ..... 2018-029136

(51) Int. Cl.
*G03G 9/087* (2006.01)
*G03G 9/08* (2006.01)

(52) U.S. Cl.
CPC ..... *G03G 9/08755* (2013.01); *G03G 9/0821* (2013.01); *G03G 9/0827* (2013.01); *G03G 9/08795* (2013.01); *G03G 9/08797* (2013.01)

(58) Field of Classification Search
CPC ..... G03G 9/09307; G03G 9/09328; G03G 9/09342; G03G 9/09371; G03G 9/093; G03G 9/09392; G03G 9/08755; G03G 9/08795; G03G 9/08797; G03G 9/0821
See application file for complete search history.

(56) References Cited

U.S. PATENT DOCUMENTS 6,096,468 A * 8/2000 Ohno ..... G03G 9/0819 430/108.3
8,609,312 B2 * 12/2013 Itabashi ..... G03G 9/08795 430/108.3
8,628,902 B2 * 1/2014 Yamasaki ..... C08G 63/672 399/252
2007/0274737 A1 * 11/2007 Serizawa ..... G03G 15/0898 399/106
2011/0262851 A1 10/2011 Takano et al.

FOREIGN PATENT DOCUMENTS

JP 2005-173315 A * 6/2005
JP 2011-232756 11/2011

OTHER PUBLICATIONS

Japanese Patent Office J-PlatPat machine-assisted English-language translation of JP 2005-173315 (pub. Jun. 2005) (Year: 2005).*

* cited by examiner

*Primary Examiner* — Christopher D Rodee
(74) *Attorney, Agent, or Firm* — JCIPRNET

(57) ABSTRACT

An electrostatic-image developing toner contains toner particles containing a polyester resin having an acid value of from 10 mg KOH/g to less than 15 mg KOH/g. The toner particles have a surface with an acid value in a range from 0.3% to 1.7% of the acid value of the polyester resin. The toner particles have a melt viscosity of from 1,800 Pa·s to 3,800 Pa·s at 100° C.

18 Claims, 2 Drawing Sheets

ELECTROSTATIC-IMAGE DEVELOPING TONER, ELECTROSTATIC IMAGE DEVELOPER, AND TONER CARTRIDGE

CROSS-REFERENCE TO RELATED APPLICATIONS

This application is based on and claims priority under 35 USC 119 from Japanese Patent Application No. 2018-029136 filed Feb. 21, 2018.

BACKGROUND

(i) Technical Field

The present disclosure relates to electrostatic-image developing toners, electrostatic image developers, and toner cartridges.

(ii) Related Art

Methods for visualizing image information, such as electrophotography, are currently used in various fields. In electrophotography, charging and electrostatic image formation are performed to form an electrostatic image as image information on the surface of an image carrier. A developer containing a toner is then used to form a toner image on the surface of the image carrier. This toner image is transferred to a recording medium and is then fixed to the recording medium. These steps visualize the image information as an image.

For example, Japanese Unexamined Patent Application Publication No. 2011-232756 discloses an electrophotographic toner containing a binder resin, a colorant, and a release agent and having a volume average particle size of 7 μm or less and an acid value per unit surface area, SAV (mg KOH/$m^2$), of from 0.05 to 0.2.

SUMMARY

Aspects of non-limiting embodiments of the present disclosure relate to an electrostatic-image developing toner that exhibits less decrease in charge stability in a high-temperature, high-humidity environment and less decrease in fixed image strength than an electrostatic-image developing toner comprising toner particles that contain a polyester resin having an acid value of from 10 mg KOH/g to less than 15 mg KOH/g and that have a surface with an acid value of less than 0.3% or more than 1.7% of the acid value of the polyester resin, have a melt viscosity of less than 1,800 Pa·s at 100° C., or have a glass transition temperature of lower than 30° C.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided an electrostatic-image developing toner comprising toner particles containing a polyester resin having an acid value of from 10 mg KOH/g to less than 15 mg KOH/g. The toner particles have a surface with an acid value in a range from 0.3% to 1.7% of the acid value of the polyester resin. The toner particles have a melt viscosity of from 1,800 Pa·s to 3,800 Pa·s at 100° C.

BRIEF DESCRIPTION OF THE DRAWINGS

An exemplary embodiment of the present disclosure will be described in detail based on the following figures, wherein.

DETAILED DESCRIPTION

Figure 1:
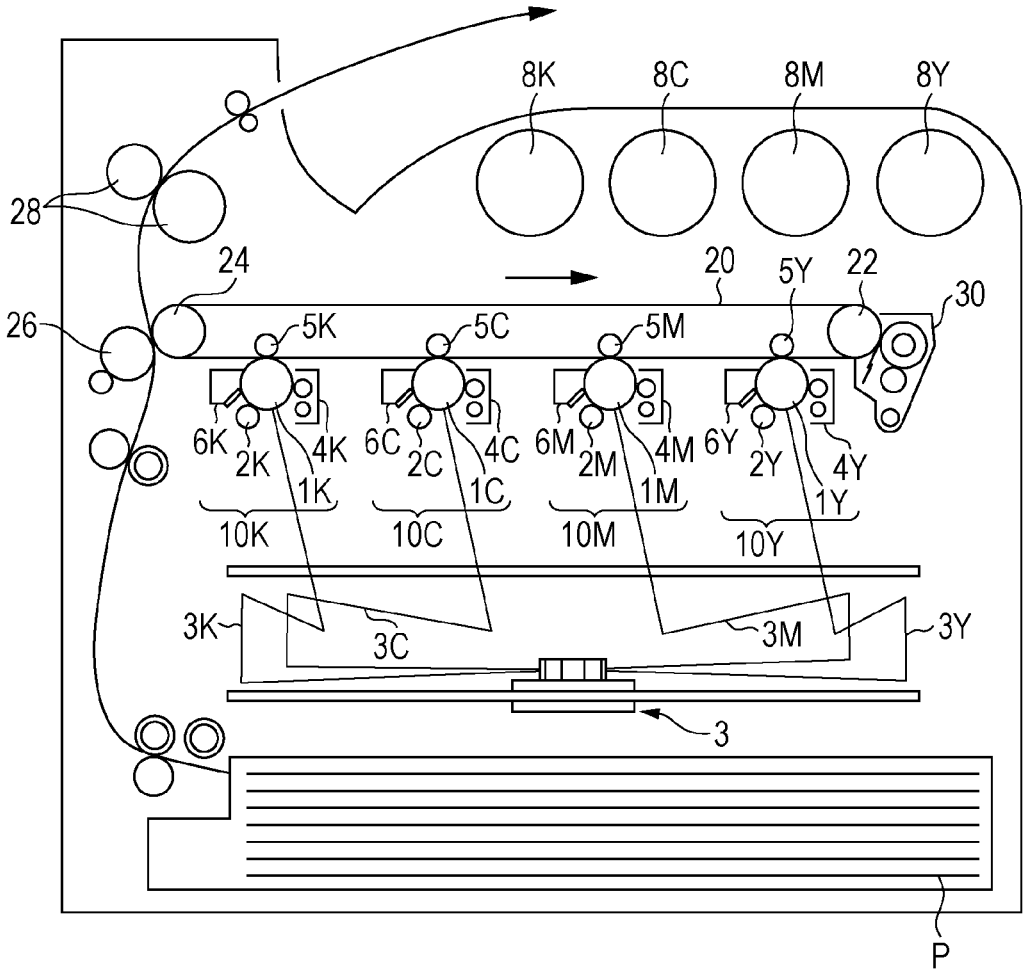
FIG. 1 is a schematic view showing an example image-forming apparatus according to the exemplary embodiment.

An exemplary embodiment of the present disclosure will now be described in detail.

Electrostatic-Image Developing Toner

An electrostatic-image developing toner (hereinafter referred to as "toner") according to the exemplary embodiment comprises toner particles containing a polyester resin having an acid value of from 10 mg KOH/g to less than 15 mg KOH/g. The toner particles have a surface with an acid value in a range from 0.3% to 1.7% of the acid value of the polyester resin.

The toner particles of the toner according to the exemplary embodiment have a melt viscosity of from 1,800 Pa·s to 3,800 Pa·s at 100° C. or a glass transition temperature of from 30° C. to 55° C.

The toner particles of the toner according to the exemplary embodiment may have a melt viscosity of from 1,800 Pa·s to 3,800 Pa·s at 100° C. and a glass transition temperature of from 30° C. to 55° C.

When a polyester resin having an acid value of from 10 mg KOH/g to less than 15 mg KOH/g is used as a binder resin for toner particles, the charge stability of the toner tends to decrease in a high-temperature, high-humidity environment because of the high acid value of the polyester resin in the surface of the toner particles. In addition, the strength of the resulting fixed image tends to decrease because the toner particles would soften and exhibit low melt viscosity or hardness.

In contrast, with the configuration described above, although the toner according to the exemplary embodiment contains a polyester resin having an acid value of from 10 mg KOH/g to less than 15 mg KOH/g, the toner particles have a surface with a lower acid value than the polyester resin, i.e., in a range from 0.3% to 1.7% of the acid value of the polyester resin. This may improve the charge stability of the toner in a high-temperature, high-humidity environment.

In addition, the toner particles containing a polyester resin having an acid value of from 10 mg KOH/g to less than 15 mg KOH/g not only have a surface with an acid value within the above range, but also have a melt viscosity of from 1,800 Pa·s to 3,800 Pa·s at 100° C. or a glass transition temperature of from 30° C. to 55° C. This may increase the strength of the toner particles and may thus increase the strength of the resulting fixed image.

Thus, with the configuration described above, the toner according to the exemplary embodiment may have both high charge stability in a high-temperature, high-humidity environment and high fixed image strength.

In particular, the toner according to the exemplary embodiment may have high charge stability in a high-temperature, high-humidity environment and high toner particle strength although the toner particles contain a polyester resin having an acid value of from 10 mg KOH/g to less than 15 mg KOH/g. This may also contribute to, for example, 1) improved cleanability in a high-temperature, high-humidity environment; 2) a reduced likelihood of the phenomenon in which the toner particles adhere to a non-image area of a recording medium (hereinafter also referred to as "fogging"); 3) stability of transfer efficiency in a high-temperature, high-humidity environment; 4) reduced image density unevenness; and 5) a reduced likelihood of the phenomenon in which overheated toner adheres to a fixing member (hereinafter also referred to as "hot offset").

The toner according to the exemplary embodiment will now be described in detail.

The toner according to the exemplary embodiment comprises toner particles. The toner may contain an external additive added to the toner particles.

Toner Particles

The toner particles contain a polyester resin as a binder resin. The toner particles may contain a colorant, a release agent, and other additives.

Properties of Toner Particles

The toner particles have a surface with an acid value in a range from 0.3% to 1.7% of the acid value of the polyester resin. From the viewpoint of charge stability in a high-temperature, high-humidity environment, the toner particles preferably have a surface with an acid value in a range from 0.4% to 1.5%, more preferably from 0.5% to 1.0%, of the acid value of the polyester resin.

The acid value of the surface of the toner particles is measured in accordance with the "potentiometric titration method" specified in JIS K0070 (1992).

The toner particles have a melt viscosity of from 1,800 Pa·s to 3,800 Pa·s at 100° C. From the viewpoint of fixed image strength, the toner particles preferably have a melt viscosity of from 2,000 Pa·s to 3,500 Pa·s, more preferably from 2,500 Pa·s to 3,200 Pa·s, at 100° C.

The melt viscosity of the toner particles at 100° C. is measured as follows.

After 1.2 g of the toner is formed into a cylindrical shape with a sampler, the melt viscosity of the toner is measured with a flow tester (CFT-500 manufactured by Shimadzu Corporation) under the following conditions. The amount of extrudate is measured at each temperature in increments of 1° C., and the viscosity (Pa·s) at 100° C. is obtained. The measurement environment is set to a temperature of 20° C. and a humidity of 50% RH.

Die (nozzle) diameter=0.5 mm, thickness=1.0 mm

Extrusion load=10 kgf/cm$^2$

Plunger cross-sectional area=1.0 cm$^2$

Initial set temperature=50° C.

Preheat time=300 sec

Constant-rate heating at heating rate of 1° C./min

The toner particles have a glass transition temperature (Tg) of from 30° C. to 55° C. From the viewpoint of fixed image strength, the toner particles preferably have a glass transition temperature (Tg) of from 32° C. to 50° C., more preferably from 34° C. to 48° C.

The glass transition temperature of the toner particles is determined from a differential scanning calorimetry (DSC) curve obtained by DSC. More specifically, the glass transition temperature is determined as the "extrapolated glass transition initiation temperature" specified in the method for determining glass transition temperature in JIS K 7121-1987 "Testing Methods for Transition Temperatures of Plastics".

If the toner particles have an external additive added to the surface thereof, the above measurements are performed on toner particles from which the external additive has been removed by a process such as sonication. Sonication may be performed, for example, by applying ultrasonic vibrations at a power of 20 W and a frequency of 20 kHz to toner dispersed in a dispersion (e.g., a 10% by mass aqueous ethanol solution) in a concentration of 1% by mass for 30 minutes, thereby removing the external additive.

The surface acid value, melt viscosity, and hardness of the toner particles may be adjusted within the above ranges, for example, by the following methods:

1) A method in which toner particles are prepared by an aggregation and coalescence process using a dispersion containing resin particles formed of a polyester resin having an acid value of from 10 mg KOH/g to less than 15 mg KOH/g and having a surface with an acid value in a range from 0.3% to 1.7% of the acid value of the polyester resin. The method for manufacturing the resin particles will be described later.

2) A method in which, when toner particles having a core-shell structure composed of a core (core particle) and a coating layer (shell layer) coating the core is prepared by an aggregation and coalescence process, the amount of polyester resin particles for forming the core particles and the amount of polyester resin particles for forming the shell layer (for addition) are adjusted. Specifically, the acid value of the surface of the toner particles tends to increase as the amount of polyester resin particles for forming the core particles is decreased and the amount of polyester resin particles for forming the shell layer is increased. Conversely, the acid value of the surface of the toner particles tends to decrease as the amounts of polyester particles are reversed.

The toner particles may contain at least one of sodium (Na), sulfur (S), and aluminum (Al).

Na functions to increase the melt viscosity and toner hardness of the toner particles by forming coordination bonds with the carboxy groups of the polyester resin in the toner particles.

S is present as a cation serving as a counterion for the sulfonate of a sulfonate salt used as a surfactant component and functions to increase the melt viscosity and toner hardness of the toner particles by forming coordination bonds with the carboxyl groups of the polyester resin in the toner particles.

Al functions to increase the melt viscosity and toner hardness of the toner particles by forming ionic bonds with the carboxy groups of the polyester resin in the toner particles.

Thus, if the toner particles contain at least one of Na, S, and Al, the fixed image strength may be improved.

From the viewpoint of charge stability in a high-temperature, high-humidity environment and fixed image strength, Na is preferably present in an amount of from 0.05% by mass to 0.25% by mass, more preferably from 0.10% by mass to 0.20% by mass, even more preferably from 0.12% by mass to 0.15% by mass, based on the mass of the toner particles.

Examples of Na sources include additives (e.g., surfactants, pH adjusters, and coagulants) containing sodium salts.

Examples of surfactants include those used to disperse various particles in dispersions when preparing toner particles by aggregation and coalescence processes. Specific examples of such surfactants include anionic surfactants such as sodium salts of sulfate esters, sulfonates, polyacrylates, phosphate esters, and soaps.

Examples of pH adjusters include those added to adjust the pH of a dispersion to form aggregated particles when preparing toner particles by aggregation and coalescence processes. Specific examples of such pH adjusters include sodium hydroxide, sodium metasilicate, sodium carbonate, sodium hydrogen carbonate, and sodium acetate.

Examples of coagulants include those used to aggregate various particles when preparing toner particles by aggregation and coalescence processes. Specific examples of such coagulants include sodium sulfate.

Other examples of additives serving as Na sources include sodium hydroxide (NaOH) and sodium chloride (NaCl).

The amount of Na can be adjusted by changing the amounts of these additives. The amount of Na can also be adjusted by changing the amount of chelating agent for removing the coagulant and the degree of washing of the toner particles.

From the viewpoint of charge stability in a high-temperature, high-humidity environment and fixed image strength, S is preferably present in an amount of from 0.06% by mass to 0.15% by mass, more preferably from 0.07% by mass to 0.13% by mass, even more preferably from 0.08% by mass to 0.11% by mass, based on the mass of the toner particles.

Examples of S sources include additives (e.g., surfactants and coagulants) containing S.

Examples of surfactants include those used to disperse various particles in dispersions when preparing toner particles by aggregation and coalescence processes. Specific examples of such surfactants include anionic surfactants such as sulfate esters and sulfonates (e.g., sodium dodecylsulfonate, sodium dodecylbenzenesulfonate, and sodium dialkylsulfosuccinate).

Examples of coagulants include those used to aggregate various particles when preparing toner particles by aggregation and coalescence processes. Specific examples of such coagulants include aluminum sulfate, magnesium sulfate, potassium sulfate, sodium sulfate, calcium sulfate, and zinc sulfate.

The amount of S can be adjusted by changing the amounts of these additives. The amount of S can also be adjusted by changing the amount of chelating agent for removing the coagulant and the degree of washing of the toner particles.

From the viewpoint of charge stability in a high-temperature, high-humidity environment and fixed image strength, Al is preferably present in an amount of from 0.01% by mass to 0.03% by mass, more preferably from 0.013% by mass to 0.025% by mass, even more preferably from 0.015% by mass to 0.023% by mass, based on the mass of the toner particles.

Examples of Al sources include additives (e.g., coagulants) containing aluminum salts.

Examples of coagulants include those used to aggregate various particles when preparing toner particles by aggregation and coalescence processes. Specific examples of such coagulants include aluminum salts (e.g., aluminum sulfate and aluminum chloride) and aluminum salt polymers (e.g., polyaluminum chloride and polyaluminum hydroxide).

The amount of Al can be adjusted by changing the amounts of these additives. The amount of Al can also be adjusted by changing the amount of chelating agent for removing the coagulant and the degree of washing of the toner particles.

The amounts of Na, S, and Al are measured by quantitative analysis of the toner particles for fluorescence X-ray intensity. Specifically, the measurement is performed as follows. A source of each element is first mixed with a resin to obtain a resin mixture containing a known concentration of the element. A pelletizer is then used to pelletize 200 mg of the resin mixture into a pellet sample with a diameter of 13 mm. The mass of the pellet sample is precisely measured, and the pellet sample is subjected to fluorescence X-ray intensity measurement to determine the peak intensity of each element. Similarly, measurements are performed on pellet samples with varying amounts of element source added. The results of these measurements are used to create a calibration curve. This calibration curve is used to perform quantitative analysis of the amount of each element present in the toner particles of interest.

The fluorescence X-ray spectrometer used to measure the amounts of Na, S, and Al is a fluorescence X-ray spectrometer (XRF-1500) manufactured by Shimadzu Corporation. The measurement is performed at a tube voltage of 40 kV and a tube current of 70 mA.

The sample used for quantitative analysis of fluorescence X-ray intensity is obtained by compression molding of 0.12 g of the material of interest with a press molding machine under a load of 6 t for 1 minute.

If the toner particles have an external additive added to the surface thereof, the measurement of the amounts of Na, S, and Al is performed on toner particles from which the external additive has been removed by a process such as sonication. Sonication may be performed, for example, by applying ultrasonic vibrations at a power of 20 W and a frequency of 20 kHz to toner dispersed in a dispersion (e.g., a 10% by mass aqueous ethanol solution) in a concentration of 1% by mass for 30 minutes.

The amounts of Na, S, and Al are expressed herein as the mass fractions of those elements relative to the total mass of the toner particles.

For example, the amount of Na may be the amount of Na derived from sodium salts (e.g., sodium sulfate, sodium dodecylbenzenesulfonate, sodium hydroxide, sodium chloride, sodium nitrate, and sodium dialkylsulfosuccinate). The amount of S may be the amount of S derived from sulfate salts (e.g., metal sulfates, metal dodecyl sulfates, and metal sulfides), and sulfonate salts (e.g., metal dodecylbenzenesulfonates). The amount of Al may be the amount of Al derived from aluminum salts (e.g., aluminum sulfate, aluminum chloride, aluminum nitrate, and aluminum hydroxide).

Binder Resin

The binder resin is a polyester resin having an acid value of from 10 mg KOH/g to less than 15 mg KOH/g (preferably from 11 mg KOH/g to less than 14 mg KOH/g).

The acid value of the polyester resin is measured by the neutralization titration method specified in JIS K0070 (1992).

The polyester resin may be any polyester resin having an acid value within the above range, for example, a polycondensate of a polycarboxylic acid and a polyhydric alcohol. The polyester resin may be either a commercially available polyester resin or a synthesized polyester resin.

Examples of polycarboxylic acids include aliphatic dicarboxylic acids (e.g., oxalic acid, malonic acid, maleic acid, fumaric acid, citraconic acid, itaconic acid, glutaconic acid, succinic acid, alkenylsuccinic acid, adipic acid, and sebacic acid), alicyclic dicarboxylic acids (e.g., cyclohexanedicarboxylic acid), aromatic dicarboxylic acids (e.g., terephthalic acid, isophthalic acid, phthalic acid, and naphthalenedicarboxylic acid), and anhydrides and lower alkyl (e.g., having from 1 to 5 carbon atoms) esters thereof. Of these, preferred polycarboxylic acids are, for example, aromatic dicarboxylic acids.

The polycarboxylic acid may be a combination of a dicarboxylic acid with a tri- or higher-carboxylic acid that forms a crosslinked structure or a branched structure. Examples of tri- and higher-carboxylic acids include trimellitic acid, pyromellitic acid, and anhydrides and lower alkyl (e.g., having from 1 to 5 carbon atoms) esters thereof.

These polycarboxylic acids may be used alone or in combination.

Examples of polyhydric alcohols include aliphatic diols (e.g., ethylene glycol, diethylene glycol, triethylene glycol, propylene glycol, butanediol, hexanediol, and neopentyl glycol), alicyclic diols (e.g., cyclohexanediol, cyclohexanedimethanol, and hydrogenated bisphenol A), and aromatic diols (e.g., ethylene oxide adducts of bisphenol A and propylene oxide adducts of bisphenol A). Of these, preferred polyhydric alcohols are, for example, aromatic diols and alicyclic diols, more preferably aromatic diols.

The polyhydric alcohol may be a combination of a diol with a tri- or higher-hydric alcohol that forms a crosslinked structure or a branched structure. Examples of tri- and higher-hydric alcohols include glycerol, trimethylolpropane, and pentaerythritol.

These polyhydric alcohols may be used alone or in combination.

The polyester resin preferably has a glass transition temperature (Tg) of from 50° C. to 80° C., more preferably from 50° C. to 65° C.

The glass transition temperature is determined from a differential scanning calorimetry (DSC) curve obtained by DSC. More specifically, the glass transition temperature is determined as the "extrapolated glass transition initiation temperature" specified in the method for determining glass transition temperature in JIS K 7121-1987 "Testing Methods for Transition Temperatures of Plastics".

The polyester resin preferably has a weight average molecular weight (Mw) of from 5,000 to 1,000,000, more preferably from 7,000 to 500,000.

The polyester resin may have a number average molecular weight (Mn) of from 2,000 to 100,000.

The polyester resin preferably has a molecular weight distribution Mw/Mn of from 1.5 to 100, more preferably from 2 to 60.

The weight average molecular weight and the number average molecular weight are measured by gel permeation chromatography (GPC). The measurement system used for molecular weight measurement by GPC is an HLC-8120 GPC system manufactured by Tosoh Corporation. A TSKgel Super HM-M column (15 cm) manufactured by Tosoh Corporation is used. The measurement is performed using THF as a solvent. The weight average molecular weight and the number average molecular weight are calculated from the measurement results using a molecular weight calibration curve created from monodisperse polystyrene standards.

The polyester resin is obtained by a known method of manufacture. Specifically, for example, the polyester resin is obtained by a method in which monomers are reacted at a polymerization temperature of from 180° C. to 230° C., optionally while maintaining a reduced pressure in the reaction system to remove any water and alcohol produced by condensation.

If the monomers used as the starting materials are insoluble or incompatible at the reaction temperature, the monomers may be dissolved by adding a high-boiling-point solvent as a solubilizer. In this case, the polycondensation reaction is performed while distilling off the solubilizer. If there is any poorly compatible monomer, the poorly compatible monomer may be condensed with any acid or alcohol to be polycondensed with that monomer in advance before being polycondensed together with the major ingredients.

The binder resin may be a combination of the polyester resin with other binder resins. The polyester resin may account for 60% by mass or more (preferably 80% by mass or more, more preferably 90% by mass or more) of the binder resin.

Examples of other binder resins include vinyl resins formed of homopolymers and copolymers of monomers such as styrenes (e.g., styrene, p-chlorostyrene, and α-methylstyrene), (meth)acrylates (e.g., methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, and 2-ethylhexyl methacrylate), ethylenically unsaturated nitriles (e.g., acrylonitrile and methacrylonitrile), vinyl ethers (e.g., vinyl methyl ether and vinyl isobutyl ether), vinyl ketones (e.g., vinyl methyl ketone, vinyl ethyl ketone, and vinyl isopropenyl ketone), and olefins (e.g., ethylene, propylene, and butadiene).

Other examples of binder resins include non-vinyl resins such as epoxy resins, polyurethane resins, polyamide resins, cellulose resins, polyether resins, and modified rosins; mixtures of these non-vinyl resins with the vinyl resins listed above; and graft polymers obtained by polymerizing vinyl monomers in the presence of these non-vinyl resins.

These other binder resins may be used alone or in combination.

The binder resin is preferably present in an amount of, for example, from 40% by mass to 95% by mass, more preferably from 50% by mass to 90% by mass, even more preferably from 60% by mass to 85% by mass, of the total mass of the toner particles.

Colorant

Examples of colorants include various pigments such as carbon black, chrome yellow, Hansa yellow, benzidine yellow, threne yellow, quinoline yellow, pigment yellow, Permanent Orange GTR, pyrazolone orange, Vulcan orange, Watchung red, permanent red, Brilliant Carmine 3B, Brilliant Carmine 6B, DuPont oil red, pyrazolone red, lithol red, Rhodamine B Lake, Lake Red C, pigment red, rose bengal, aniline blue, ultramarine blue, calco oil blue, methylene blue chloride, phthalocyanine blue, pigment blue, phthalocyanine green, and malachite green oxalate; and various dyes such as acridine dyes, xanthene dyes, azo dyes, benzoquinone dyes, azine dyes, anthraquinone dyes, thioindigo dyes, dioxazine dyes, thiazine dyes, azomethine dyes, indigo dyes, phthalocyanine dyes, aniline black dyes, polymethine dyes, triphenylmethane dyes, diphenylmethane dyes, and thiazole dyes.

These colorants may be used alone or in combination.

The colorant may optionally be surface-treated and may be used in combination with a dispersant. A combination of colorants may also be used.

The colorant is preferably present in an amount of, for example, from 1% by mass to 30% by mass, more preferably from 3% by mass to 15% by mass, of the total mass of the toner particles.

Release Agent

Examples of release agents include, but not limited to, hydrocarbon waxes; natural waxes such as carnauba wax, rice wax, and candelilla wax; synthetic and mineral/petroleum waxes such as montan wax; and ester waxes such as fatty acid esters and montanic acid esters.

The release agent preferably has a melting temperature of from 50° C. to 110° C., more preferably from 60° C. to 100° C.

The melting temperature is determined from a differential scanning calorimetry (DSC) curve obtained by DSC as the "melting peak temperature" specified in the method for determining melting temperature in JIS K 7121-1987 "Testing Methods for Transition Temperatures of Plastics".

The release agent is preferably present in an amount of, for example, from 1% by mass to 20% by mass, more preferably from 5% by mass to 15% by mass, of the total mass of the toner particles.

Other Additives

Examples of other additives include known additives such as magnetic materials, charge control agents, and inorganic powders. These additives are incorporated into the toner particles as internal additives.

Properties and Other Details of Toner Particles

The toner particles may be either toner particles having a single-layer structure or toner particles having a structure composed of a core (core particle) and a coating layer (shell layer) coating the core, i.e., a core-shell structure.

The toner particles having a core-shell structure may be composed of, for example, a core containing a binder resin and optionally a colorant, a release agent, and other additives and a coating layer containing a binder resin.

The toner particles preferably have a volume average particle size (D50v) of from 2 μm to 10 μm, more preferably from 4 μm to 8 μm.

The various average particle sizes and various particle size distribution indices of the toner particles are measured with a Coulter Multisizer II (manufactured by Beckman Coulter, Inc.). ISOTON-II (manufactured by Beckman Coulter, Inc.) is used as an electrolyte solution.

Prior to measurement, from 0.5 mg to 50 mg of a measurement sample is added to 2 mL of a 5% aqueous solution of a surfactant (e.g., sodium alkylbenzenesulfonate), serving as a dispersant. The mixture is added to from 100 mL to 150 mL of the electrolyte solution.

The electrolyte solution having the sample suspended therein is subjected to dispersion treatment with a sonicator for 1 minute. The particle size distribution of particles having particle sizes in the range from 2 μm to 60 μm is measured with a Coulter Multisizer II using an aperture with an aperture diameter of 100 μm. A total of 50,000 particles are sampled.

The measured particle size distribution is divided into particle size ranges (channels). Cumulative volume and number distributions are plotted against the particle size ranges from smaller to larger sizes. The volume particle size D16v and the number particle size D16p are defined as the particle size at which the cumulative volume or number is 16%. The volume average particle size D50v and the number average particle size D50p are defined as the particle size at which the cumulative volume or number is 50%. The volume particle size D84v and the number particle size D84p are defined as the particle size at which the cumulative volume or number is 84%.

These values are used to calculate the volume particle size distribution index (GSDv) as $(D84v/D16v)^{1/2}$ and the number particle size distribution index (GSDp) as $(D84p/D16p)^{1/2}$.

The toner particles preferably have an average circularity of from 0.94 to 1.00, more preferably from 0.95 to 0.98.

The average circularity of the toner particles is determined as (equivalent circle perimeter)/(perimeter) (i.e., (perimeter of circle with projected area equal to that of particle image)/(perimeter of projected particle image)). Specifically, the average circularity is measured by the following method.

The toner particles of interest are first sampled by suction to form a flat flow. Particle images are then captured as still images by causing a strobe to flash. These particle images are fed to a flow particle image analyzer (FPIA-3000 manufactured by Sysmex Corporation) for image analysis to determine the average circularity. A total of 3,500 particles are sampled to determine the average circularity.

If the toner contains an external additive, the toner (developer) of interest is dispersed in water containing a surfactant and is then sonicated to obtain toner particles from which the external additive has been removed.

External Additive

Examples of external additives include inorganic particles. Examples of inorganic particles include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)_n$, $Al_2O_3.2SiO_2$, $CaCO_3$, $MgCO_3$, $BaSO_4$, and $MgSO_4$.

The surface of the inorganic particles serving as the external additive may be subjected to hydrophobic treatment. Hydrophobic treatment is performed, for example, by immersing the inorganic particles in a hydrophobic agent. Examples of hydrophobic agents include, but not limited to, silane coupling agents, silicone oils, titanate coupling agents, and aluminum coupling agents. These may be used alone or in combination.

The hydrophobic agent is typically used in an amount of, for example, from 1 part by mass to 10 parts by mass based on 100 parts by mass of the inorganic particles.

Other examples of external additives include resin particles (particles of resins such as polystyrene, polymethyl methacrylate (PMMA), and melamine resins) and cleaning active agents (e.g., particles of metal salts of higher fatty acids, such as zinc stearate, and fluoropolymers).

The external additive is preferably added in an amount of, for example, from 0.01% by mass to 5% by mass, more preferably from 0.01% by mass to 2.0% by mass, based on the mass of the toner particles.

Method for Manufacturing Toner

A method for manufacturing the toner according to the exemplary embodiment will be described next.

The toner according to the exemplary embodiment is obtained by manufacturing toner particles and then adding an external additive to the toner particles.

The toner particles may be manufactured by either dry processes (e.g., compounding and pulverization processes) or wet processes (e.g., aggregation and coalescence processes, suspension polymerization processes, or solution suspension processes). The toner particles may be manufactured by any of these processes, and known processes are employed.

Of these, aggregation and coalescence processes are preferably employed to obtain the toner particles.

Specifically, for example, if the toner particles are manufactured by an aggregation and coalescence process, the toner particles are manufactured by a step of providing a resin particle dispersion in which resin particles serving as a binder resin are dispersed (resin-particle-dispersion providing step); a step of aggregating the resin particles (and optionally other particles) in the resin particle dispersion (or optionally in a mixture of the dispersion with other particle dispersions) to form aggregated particles (aggregated-particle forming step); and a step of fusing and coalescing the aggregated particles by heating the aggregated particle dispersion in which the aggregated particles are dispersed to form toner particles (fusing and coalescing step).

The binder resin used is a polyester resin having an acid value of from 10 mg KOH/g to less than 15 mg KOH/g.

The individual steps will now be described in detail.

Although a method for obtaining toner particles containing a colorant and a release agent will be described below, the colorant and the release agent are optionally used. It should be understood that additives other than colorants and release agents may also be used.

Resin-Particle-Dispersion Providing Step

A resin particle dispersion in which resin particles serving as a binder resin are dispersed is provided first. In addition, for example, a colorant particle dispersion in which colorant particles are dispersed and a release agent particle dispersion in which release agent particles are dispersed are provided.

The resin particle dispersion is prepared, for example, by dispersing resin particles in a dispersion medium with a surfactant.

The dispersion medium used in the resin particle dispersion may be, for example, an aqueous medium.

Examples of aqueous media include water, such as distilled water and deionized water, and alcohols. These may be used alone or in combination.

Examples of surfactants include anionic surfactants such as sulfate ester salts, sulfonate salts, phosphate esters, and soaps; cationic surfactants such as amine salts and quaternary ammonium salts; and nonionic surfactants such as polyethylene glycols, alkylphenol-ethylene oxide adducts, and polyhydric alcohols. Of these, in particular, anionic surfactants and cationic surfactants may be used. Nonionic surfactants may be used in combination with anionic surfactants and cationic surfactants.

These surfactants may be used alone or in combination.

Examples of techniques for dispersing the resin particles in the dispersion medium for the resin particle dispersion include common dispersion techniques such as rotary shear homogenizers and media mills such as ball mills, sand mills, and Dyno-Mill. Depending on the type of resin particles, the resin particles may also be dispersed in the resin particle dispersion, for example, by phase inversion emulsification.

Phase inversion emulsification is a technique for dispersing a resin in the form of particles in an aqueous medium by dissolving the resin to be dispersed into a hydrophobic organic solvent in which the resin is soluble, neutralizing the organic continuous phase (O-phase) by adding a base, and introducing an aqueous medium (W-phase) to convert the resin from W/O to O/W (i.e., phase inversion), thereby forming a discontinuous phase.

In phase inversion emulsification, the acid value of the surface of the resin particles formed of the polyester resin serving as the binder resin (a polyester resin having an acid value of from 10 mg KOH/g to less than 15 mg KOH/g) may be adjusted within the range from 0.3% to 1.7% of the acid value of the polyester resin by the following methods:

1) A method in which the polyester resin is melted with heat and is mixed with a base and a surfactant before an aqueous medium is introduced.

2) A method in which the polyester resin is dissolved into an organic solvent and is neutralized by adding a base before an aqueous medium is introduced.

The resin particles dispersed in the resin particle dispersion preferably have a volume average particle size of, for example, from 0.01 μm to 1 μm, more preferably from 0.08 μm to 0.8 μm, even more preferably from 0.1 μm to 0.6 μm.

The volume average particle size of the resin particles is measured as follows. A particle size distribution obtained by measurement with a laser diffraction particle size distribution analyzer (e.g., LA-700 manufactured by Horiba, Ltd.) is divided into particle size ranges (channels). A cumulative volume distribution is plotted against the particle size ranges from smaller to larger particle sizes. The volume average particle size D50v is measured as the particle size at which the cumulative volume is 50% of all particles. The volume average particle sizes of the particles in other dispersions are similarly measured.

The resin particles are preferably present in the resin particle dispersion in an amount of, for example, from 5% by mass to 50% by mass, more preferably from 10% by mass to 40% by mass.

The colorant particle dispersion and the release agent particle dispersion, for example, are prepared in the same manner as the resin particle dispersion. That is, the volume average particle size, the medium and technique for dispersion, and the amount of particles in the resin particle dispersion also apply to the colorant particles dispersed in the colorant particle dispersion and the release agent particles dispersed in the release agent particle dispersion.

Aggregated-Particle Forming Step

The resin particle dispersion is then mixed with the colorant particle dispersion and the release agent particle dispersion.

The resin particles, the colorant particles, and the release agent particles undergo heteroaggregation in the mixed dispersion to form aggregated particles including the resin particles, the colorant particles, and the release agent particles. The size of the aggregated particles is close to the target size of the toner particles.

Specifically, for example, the mixed dispersion is heated after adding a coagulant to the mixed dispersion, adjusting the pH of the mixed dispersion to an acidic level (e.g., a pH of from 2 to 5), and optionally adding a dispersion stabilizer. The mixed dispersion is heated to the glass transition temperature of the resin particles (specifically, for example, from the glass transition temperature of the resin particles minus 30° C. to the glass transition temperature minus 10° C.) to aggregate the particles dispersed in the mixed dispersion, thereby forming aggregated particles.

In the aggregated-particle forming step, for example, heating may be performed after adding the coagulant at room temperature (e.g., 25° C.), adjusting the pH of the mixed dispersion to an acidic level (e.g., a pH of from 2 to 5), and optionally adding a dispersion stabilizer while stirring the mixed dispersion with a rotary shear homogenizer.

Examples of coagulants include surfactants of opposite polarity to the surfactant used as the dispersant added to the mixed dispersion, inorganic metal salts, and di- and higher-valent metal complexes. In particular, if a metal complex is used as the coagulant, the amount of surfactant used may be reduced. This may improve the charging characteristics.

Additives that form a complex or similar linkage with the metal ion of the coagulant may optionally be used. One such additive is a chelating agent.

Examples of inorganic metal salts include metal salts such as calcium chloride, calcium nitrate, barium chloride, magnesium chloride, zinc chloride, aluminum chloride, and aluminum sulfate; and inorganic metal salt polymers such as polyaluminum chloride, polyaluminum hydroxide, and calcium polysulfide.

The chelating agent may be a water-soluble chelating agent. Examples of chelating agents include oxycarboxylic acids such as tartaric acid, citric acid, and gluconic acid, iminodiacetic acid (IDA), nitrilotriacetic acid (NTA), and ethylenediaminetetraacetic acid (EDTA).

The chelating agent is preferably added in an amount of, for example, from 0.01 parts by mass to 5.0 parts by mass, more preferably from 0.1 parts by mass to less than 3.0 parts by mass, based on 100 parts by mass of the resin particles.

Fusing and Coalescing Step

The aggregated particles are then fused and coalesced, for example, by heating the aggregated particle dispersion in which the aggregated particles are dispersed to at least the glass transition temperature of the resin particles (e.g., at least a temperature that is 10° C. to 30° C. higher than the glass transition temperature of the resin particles) to form toner particles.

The foregoing steps produce toner particles.

Toner particles may also be manufactured by, after obtaining the aggregated particle dispersion in which the aggregated particles are dispersed, a step of further mixing the aggregated particle dispersion with a resin particle dispersion in which resin particles are dispersed and aggregating the resin particles such that the resin particles further adhere to the surface of the aggregated particles to form second aggregated particles and a step of fusing and coalescing the second aggregated particles by heating the second aggregated particle dispersion in which the second aggregated particles are dispersed to form toner particles having a core-shell structure.

After the completion of the fusing and coalescing step, the toner particles formed in the solution are subjected to known washing, solid-liquid separation, and drying steps to obtain dry toner particles.

The washing step may be performed by sufficient displacement washing with deionized water from the viewpoint of chargeability. The solid-liquid separation step may be performed by a process such as, but not limited to, suction filtration or pressure filtration from the viewpoint of productivity. The drying step may be performed by a process such as, but not limited to, freeze drying, flash drying, fluidized drying, or vibratory fluidized drying from the viewpoint of productivity.

The toner according to the exemplary embodiment is manufactured, for example, by adding an external additive to the resulting dry toner particles and mixing them together. Mixing may be performed, for example, with a V-blender, a Henschel mixer, or a Lodige mixer. In addition, coarse toner particles may optionally be removed, for example, with a vibrating sieve or an air sieve.

Electrostatic Image Developer

An electrostatic image developer according to the exemplary embodiment comprises at least the toner according to the exemplary embodiment.

The electrostatic image developer according to the exemplary embodiment may be a one-component developer containing only the toner according to the exemplary embodiment or a two-component developer containing the toner and a carrier.

The carrier may be any known carrier. Examples of carriers include coated carriers obtained by coating the surface of cores formed of a magnetic powder with a coating resin; magnetic-powder-dispersed carriers obtained by dispersing and blending a magnetic powder in a matrix resin; and resin-impregnated carriers obtained by impregnating a porous magnetic powder with a resin.

The constituent particles of magnetic-powder-dispersed carriers and resin-impregnated carriers may be used as cores to form carriers coated with coating resins.

Examples of magnetic powders include magnetic metals such as iron, nickel, and cobalt and magnetic oxides such as ferrite and magnetite.

Examples of coating resins and matrix resins include polyethylene, polypropylene, polystyrene, polyvinyl acetate, polyvinyl alcohol, polyvinyl butyral, polyvinyl chloride, polyvinyl ethers, polyvinyl ketones, vinyl chloride-vinyl acetate copolymers, styrene-acrylate copolymers, straight silicone resins containing organosiloxane bonds and modified products thereof, fluorocarbon resins, polyesters, polycarbonates, phenolic resins, and epoxy resins.

The coating resins and the matrix resins may contain conductive particles and other additives.

Examples of conductive particles include particles of metals such as gold, silver, and copper, carbon black, titanium oxide, zinc oxide, tin oxide, barium sulfate, aluminum borate, and potassium titanate.

An example method for coating the surface of the cores with the coating resin is coating with a solution for forming the coating layer obtained by dissolving the coating resin and optionally various additives in an appropriate solvent. Any solvent may be selected by taking into account factors such as the coating resin used and coating suitability.

Specific methods for coating the cores with the coating resin include a dipping method in which the cores are dipped in the solution for forming the coating layer, a spraying method in which the surface of the cores is sprayed with the solution for forming the coating layer, a fluidized bed method in which the cores are suspended in an air stream and are sprayed with the solution for forming the coating layer, and a kneader-coater method in which the carrier cores and the solution for forming the coating layer are mixed in a kneader-coater and the solvent is removed.

The mixing ratio (mass ratio) of the toner to the carrier in the two-component developer is preferably toner:carrier=1:100 to 30:100, more preferably 3:100 to 20:100.

Image-Forming Apparatus and Image-Forming Method

An image-forming apparatus and an image-forming method according to the exemplary embodiment will now be described.

The image-forming apparatus according to the exemplary embodiment includes an image carrier, a charging unit that charges a surface of the image carrier, an electrostatic-image forming unit that forms an electrostatic image on the charged surface of the image carrier, a developing unit that contains an electrostatic image developer and that develops the electrostatic image formed on the surface of the image carrier with the electrostatic image developer to form a toner image, a transfer unit that transfers the toner image formed on the surface of the image carrier to a surface of a recording medium, and a fixing unit that fixes the toner image transferred to the surface of the recording medium. The electrostatic image developer is the electrostatic image developer according to the exemplary embodiment.

The image-forming apparatus according to the exemplary embodiment executes an image-forming method (the image-forming method according to the exemplary embodiment) including a charging step of charging the surface of the image carrier, an electrostatic-image forming step of forming an electrostatic image on the charged surface of the image carrier, a developing step of developing the electrostatic image formed on the surface of the image carrier with the electrostatic image developer according to the exemplary embodiment to form a toner image, a transfer step of transferring the toner image formed on the surface of the image carrier to a surface of a recording medium, and a fixing step of fixing the toner image transferred to the surface of the recording medium.

The image-forming apparatus according to the exemplary embodiment may be a known type of image-forming apparatus, such as a direct-transfer apparatus that directly transfers a toner image formed on a surface of an image carrier to a recording medium; an intermediate-transfer apparatus that performs first transfer of a toner image formed on a surface of an image carrier to a surface of an intermediate transfer member and then performs second transfer of the toner image transferred to the surface of the intermediate transfer member to a surface of a recording medium; an apparatus including a cleaning unit that cleans a surface of an image carrier after the transfer of a toner image and before charging; or an apparatus including an erase unit that eliminates any charge on a surface of an image carrier by irradiation with erase light after the transfer of a toner image and before charging.

A transfer unit for an intermediate-transfer apparatus includes, for example, an intermediate transfer member having a surface to which a toner image is transferred, a first transfer unit that performs first transfer of a toner image formed on the surface of the image carrier to the surface of the intermediate transfer member, and a second transfer unit that performs second transfer of the toner image transferred to the surface of the intermediate transfer member to a surface of a recording medium.

In the image-forming apparatus according to the exemplary embodiment, for example, a section including the developing unit may be a cartridge structure (process cartridge) attachable to and detachable from the image-forming apparatus. The process cartridge may be, for example, a process cartridge including a developing unit containing the electrostatic image developer according to the exemplary embodiment.

A non-limiting example of the image-forming apparatus according to the exemplary embodiment will now be described. The parts shown in the drawings are described, and a description of other parts is omitted.

FIG. 1 is a schematic view showing the image-forming apparatus according to the exemplary embodiment.

The image-forming apparatus shown in FIG. 1 includes first to fourth electrophotographic-image forming units 10Y, 10M, 10C, and 10K that produce yellow (Y), magenta (M), cyan (C), and black (K) images, respectively, based on image data generated by color separation. These image-forming units (which may be hereinafter simply referred to as "units") 10Y, 10M, 10C, and 10K are arranged side-by-side at a predetermined distance from each other in the horizontal direction. These units 10Y, 10M, 10C, and 10K may be process cartridges attachable to and detachable from the image-forming apparatus.

An intermediate transfer belt 20 serving as an intermediate transfer member is disposed above the units 10Y, 10M, 10C, and 10K in the figure so as to extend through the units 10Y, 10M, 10C, and 10K. The intermediate transfer belt 20 is entrained about a drive roller 22 and a support roller 24 so that the intermediate transfer belt 20 runs in the direction from the first unit 10Y toward the fourth unit 10K. The drive roller 22 and the support roller 24 are disposed at a distance from each other in the direction from left to right in the figure. The support roller 24 is disposed in contact with the inner surface of the intermediate transfer belt 20. The support roller 24 is urged in a direction away from the drive roller 22 by a spring or other member (not shown) to apply tension to the intermediate transfer belt 20 entrained about both rollers 22 and 24. An intermediate-transfer-member cleaning device 30 is disposed on the image carrier side of the intermediate transfer belt 20 and opposite the drive roller 22.

The developing devices (developing units) 4Y, 4M, 4C, and 4K of the units 10Y, 10M, 10C, and 10K are supplied with toners, including yellow, magenta, cyan, and black toners, from toner cartridges 8Y, 8M, 8C, and 8K, respectively.

Since the first to fourth units 10Y, 10M, 10C, and 10K have the same configuration, the first unit 10Y, which is a yellow-image forming unit disposed upstream in the direction in which the intermediate transfer belt 20 runs, will be described herein as a representative example. The same components as those of the first unit 10Y are denoted by the same reference numerals followed by the letters M (magenta), C (cyan), and K (black) instead of the letter Y (yellow), and a description of the second to fourth units 10M, 10C, and 10K is omitted.

The first unit 10Y includes a photoreceptor 1Y serving as an image carrier. Around the photoreceptor 1Y are disposed, in sequence, a charging roller (an example of a charging unit) 2Y that charges the surface of the photoreceptor 1Y to a predetermined potential, an exposure device (an example of an electrostatic-image forming unit) 3 that exposes the charged surface to a laser beam 3Y based on image signals generated by color separation to form an electrostatic image, a developing device (an example of a developing unit) 4Y that supplies charged toner to the electrostatic image to develop the electrostatic image, a first transfer roller (an example of a first transfer unit) 5Y that transfers the developed toner image to the intermediate transfer belt 20, and a photoreceptor-cleaning device (an example of a cleaning unit) 6Y that removes any residual toner from the surface of the photoreceptor 1Y after the first transfer.

The first transfer roller 5Y is disposed inside the intermediate transfer belt 20 at a position opposite the photoreceptor 1Y. The first transfer rollers 5Y, 5M, 5C, and 5K each have connected thereto a bias supply (not shown) that applies a first transfer bias. A controller (not shown) controls each bias supply to change the transfer bias applied to each first transfer roller.

The yellow-image forming operation of the first unit 10Y will now be described.

Prior to the operation, the charging roller 2Y charges the surface of the photoreceptor 1Y to a potential of −600 V to −800 V.

The photoreceptor 1Y includes a photosensitive layer formed on a conductive substrate (e.g., having a volume resistivity of $1\times10^{-6}$ Ωcm or less at 20° C.). This photosensitive layer, which normally exhibits high resistivity (the resistivity of common resins), has the property of, upon irradiation with the laser beam 3Y, changing its resistivity in the area irradiated with the laser beam 3Y. The laser beam 3Y is emitted toward the charged surface of the photoreceptor 1Y via the exposure device 3 based on yellow image data fed from a controller (not shown). The laser beam 3Y irradiates the surface photosensitive layer of the photoreceptor 1Y to form an electrostatic image of the yellow image pattern on the surface of the photoreceptor 1Y.

An electrostatic image is an image formed by charge on the surface of the photoreceptor 1Y, i.e., a negative latent image formed after charge dissipates from the surface of the photoreceptor 1Y as the resistivity of the photosensitive layer decreases in the area irradiated with the laser beam 3Y while charge remains in the area not irradiated with the laser beam 3Y.

As the photoreceptor 1Y runs, the electrostatic image formed on the photoreceptor 1Y is rotated to a predetermined developing position. At the developing position, the electrostatic image on the photoreceptor 1Y is visualized (developed) as a toner image by the developing device 4Y.

The developing device 4Y contains, for example, an electrostatic image developer containing at least a yellow toner and a carrier. The yellow toner is triboelectrically charged by stirring inside the developing device 4Y. The yellow toner has a charge of the same polarity (negative) as the charge on the surface of the photoreceptor 1Y and is carried on a developer roller (an example of a developer carrier). As the surface of the photoreceptor 1Y passes through the developing device 4Y, the yellow toner is electrostatically attracted to the latent image area formed by eliminating the charge on the surface of the photoreceptor 1Y, so that the latent image is developed with the yellow toner. The photoreceptor 1Y having the yellow toner image formed thereon continues to run at a predetermined speed, and the toner image developed on the photoreceptor 1Y is transported to a predetermined first transfer position.

After the yellow toner image on the photoreceptor 1Y is transported to the first transfer position, a first transfer bias is applied to the first transfer roller 5Y. An electrostatic force acts on the toner image in the direction from the photoreceptor 1Y toward the first transfer roller 5Y to transfer the toner image from the photoreceptor 1Y to the intermediate transfer belt 20. The transfer bias applied during this process is of opposite polarity (positive) to the polarity of the toner (negative). For example, a controller (not shown) controls the transfer bias for the first unit 10Y to +10 μA.

The photoreceptor-cleaning device 6Y removes and collects any residual toner from the photoreceptor 1Y.

The first transfer biases applied to the first transfer rollers 5M, 5C, and 5K of the second, third, and fourth units 10M, 10C, and 10K are controlled in the same manner as the first transfer bias applied to the first transfer roller 5Y of the first unit 10Y.

In this way, the intermediate transfer belt 20 having the yellow toner image transferred thereto at the first unit 10Y is sequentially transported through the second, third, and fourth units 10M, 10C, and 10K to perform multiple transfer such that the toner images of the individual colors are superimposed on top of each other.

After the multiple transfer of the toner images of the four colors through the first to fourth units 10Y, 10M, 10C, and 10K, the intermediate transfer belt 20 is transported to a second transfer section composed of the intermediate transfer belt 20, the support roller 24 in contact with the inner surface of the intermediate transfer belt 20, and a second transfer roller (an example of a second transfer unit) 26 disposed on the image carrier side of the intermediate transfer belt 20. A sheet of recording paper (an example of a recording medium) P is fed into the gap between the second transfer roller 26 and the intermediate transfer belt 20 via a feed mechanism at a predetermined timing, and a second transfer bias is applied to the support roller 24. The transfer bias applied during this process is of the same polarity (negative) as the polarity of the toner (negative). An electrostatic force acts on the toner image in the direction from the intermediate transfer belt 20 toward the recording paper P to transfer the toner image from the intermediate transfer belt 20 to the recording paper P. The second transfer bias is set depending on the resistance detected by a resistance detector (not shown) that detects the resistance of the second transfer section, and the voltage is controlled.

Thereafter, the recording paper P is transported into a nip between a pair of fixing rollers of a fixing device (an example of a fixing unit) 28. The toner image is fixed to the recording paper P to form a fixed image.

The recording paper P to which the toner image is transferred may be, for example, plain paper used for systems such as electrophotographic copiers and printers. Examples of recording media other than the recording paper P include OHP sheets.

To further improve the smoothness of the image surface after fixing, recording paper P with a smooth surface may be used. For example, coated paper and art paper for printing may be used, which are obtained by coating the surface of plain paper with a resin or other material.

After the fixing of the color image is complete, the recording paper P is transported to an output section, and the color-image forming operation is finished.

Process Cartridge and Toner Cartridge

A process cartridge according to the exemplary embodiment will now be described.

The process cartridge according to the exemplary embodiment is attachable to and detachable from an image-forming apparatus and includes a developing unit that contains the electrostatic image developer according to the exemplary embodiment and that develops an electrostatic image formed on a surface of an image carrier with the electrostatic image developer to form a toner image.

The process cartridge according to the exemplary embodiment is not limited to the configuration described above, but may have a configuration including a developing unit and optionally at least one other unit selected from, for example, an image carrier, a charging unit, an electrostatic-image forming unit, a transfer unit, and other units.

A non-limiting example of the process cartridge according to the exemplary embodiment will now be described. The parts shown in the drawings are described, and a description of other parts is omitted.

Figure 2:
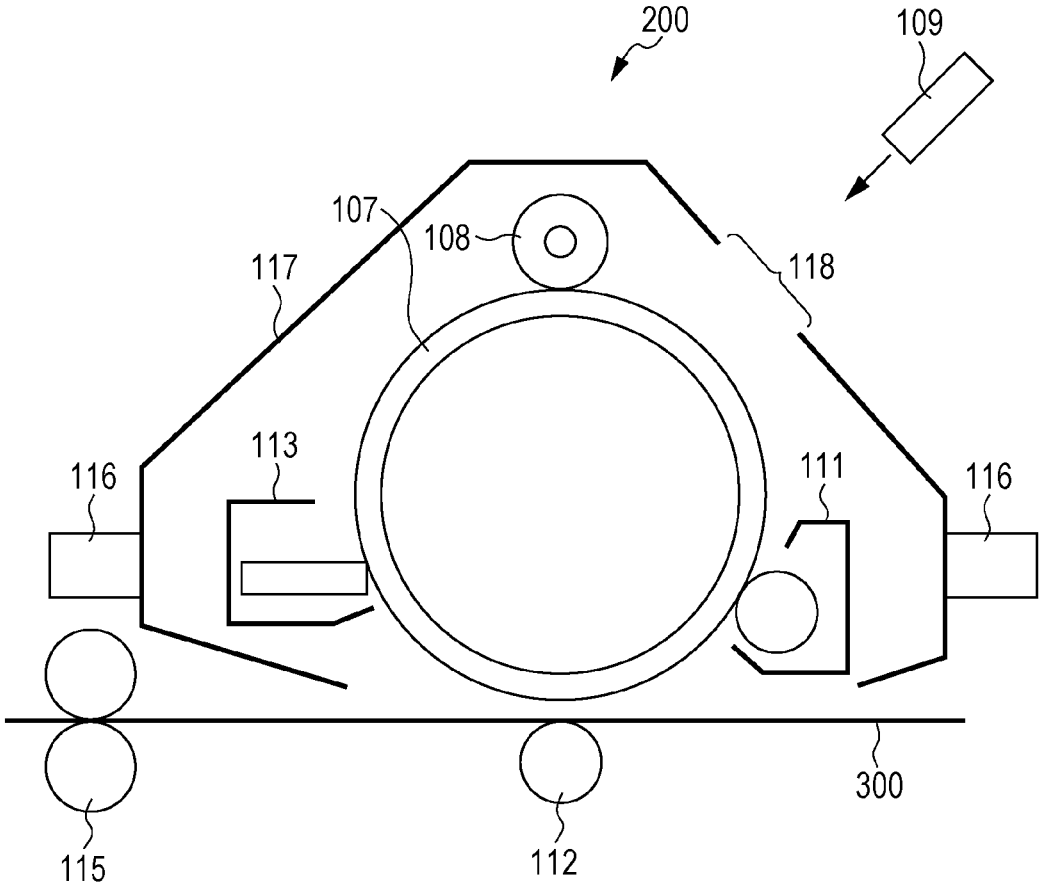
FIG. 2 is a schematic view showing an example process cartridge according to the exemplary embodiment.

FIG. 2 is a schematic view showing the process cartridge according to the exemplary embodiment.

A process cartridge 200 shown in FIG. 2 includes, for example, a photoreceptor 107 (an example of an image carrier) around which are disposed a charging roller 108 (an example of a charging unit), a developing device 111 (an example of a developing unit), and a photoreceptor-cleaning device 113 (an example of a cleaning unit). These units are combined and held together into a cartridge by a housing 117 having mounting rails 116 and an opening 118 for exposure.

In FIG. 2, reference numeral 109 denotes an exposure device (an example of an electrostatic-image forming unit), reference numeral 112 denotes a transfer device (an example of a transfer unit), reference numeral 115 denotes a fixing device (an example of a fixing unit), and reference numeral 300 denotes recording paper (an example of a recording medium).

A toner cartridge according to the exemplary embodiment will be described next.

The toner cartridge according to the exemplary embodiment is attachable to and detachable from an image-forming apparatus and contains the toner according to the exemplary embodiment. The toner cartridge contains refill toner to be supplied to a developing unit disposed in an image-forming apparatus.

The image-forming apparatus shown in FIG. 1 is configured such that the toner cartridges 8Y, 8M, 8C, and 8K are attachable to and detachable from the image-forming apparatus. The developing devices 4Y, 4M, 4C, and 4K are connected to the toner cartridges corresponding to the individual developing devices (colors) through toner supply tubes (not shown). If the toner level in any toner cartridge is low, the toner cartridge is replaced.

EXAMPLES

The following examples and comparative examples are given to describe the exemplary embodiment more specifically and in more detail, although these examples are not intended to limit the exemplary embodiment in any way. Parts and percentages representing quantities are by mass unless otherwise specified.

Example 1

Preparation of Polyester Resin Particle Dispersion (A1)

Into a material feed inlet of a twin-screw extruder (product name: TEM26SS, manufactured by Toshiba Machine Co., Ltd.) are charged 200 parts of a polyester resin (PE resin, acid value: 14.9 mg KOH/g) and 10 parts of a 20% by mass aqueous potassium hydroxide solution. In addition, 50 parts of a 15% by mass aqueous solution of sodium dodecylbenzenesulfonate (NEOPELEX G-15, manufactured by Kao Corporation) is charged as a surfactant into the fourth barrel of the twin-screw extruder. These materials are melted in the twin-screw extruder at a barrel temperature of 90° C. and a screw rotational speed of 200 rpm to obtain an oily mixture.

Thereafter, 100 parts of pure water adjusted to 90° C. is added to the fifth barrel of the twin-screw extruder, 100 parts of pure water adjusted to 90° C. is added to the seventh barrel, and 100 parts of pure water adjusted to 90° C. is added to the ninth barrel. The oily mixture is emulsified to obtain Polyester Resin Particle Dispersion (A1).

Preparation of Release Agent Particle Dispersion

Release agent (product name: FNP0090, manufactured by Nippon Seiro Co., Ltd., melting point Tw: 89.7° C.): 270 parts Anionic surfactant (Neogen RK, manufactured by DKS Co. Ltd., sodium dodecylbenzenesulfonate, active ingredient content: 60% by mass): 13.5 parts (on an active ingredient basis, 3.0% by mass based on the mass of the release agent)

Deionized water: 721.6 parts

The foregoing ingredients are mixed together. After the release agent is dissolved at an inner liquid temperature of 120° C. with a pressure discharge homogenizer (Gaulin Homogenizer, manufactured by Gaulin), the mixture is subjected to dispersion treatment at a dispersion pressure of 5 MPa for 120 minutes and then at 40 MPa for 360 minutes, followed by cooling to obtain a dispersion. The release agent particles in the dispersion have a volume average particle size D50v of 230 nm. Thereafter, the dispersion is diluted with deionized water to a solid content of 20.0% by mass to obtain a release agent particle dispersion.

Preparation of Colorant Particle Dispersion

Cyan pigment (ECB 301, manufactured by Dainichiseika Color & Chemicals Mfg. Co., Ltd.): 200 parts Anionic surfactant (Neogen SC, manufactured by DKS Co. Ltd., sodium dodecylbenzenesulfonate): 33 parts (60% by mass active ingredient, 10% by mass based on the mass of the colorant)

Deionized water: 750 parts

Into a stainless steel container are placed 280 parts of deionized water and 33 parts of the anionic surfactant. The stainless steel container is sized such that the liquid level is about one-third of the height of the container when all foregoing ingredients are charged. After the surfactant is sufficiently dissolved, all cyan pigment is charged, and the mixture is stirred with a stirrer until no dry pigment remains and is sufficiently degassed.

After degassing, the remaining deionized water is added, and the mixture is dispersed with a homogenizer (ULTRA-TURRAX T50, manufactured by IKA) at 5,000 rpm for 10 minutes and is then degassed by stirring with a stirrer for one day.

After degassing, the mixture is dispersed again with a homogenizer at 6,000 rpm for 10 minutes and is then degassed by stirring with a stirrer for one day. The dispersion is then dispersed at a pressure of 240 MPa with an Ultimaizer high-pressure impact disperser (HJP30006, manufactured by Sugino Machine Limited). Ten equivalent passes of dispersion are performed as calculated from the total amount of charge and the equipment throughput.

The resulting dispersion is allowed to stand for 72 hours, followed by removing the sediment. The dispersion is diluted with deionized water to a solid content of 15% by mass to obtain a colorant particle dispersion.

The particles in the resulting colorant particle dispersion have a volume average particle size D50v of 115 nm. The volume average particle size D50v is measured five times with a Microtrac, and the average of the three measurements other than the maximum and minimum values is used.

Preparation of Aqueous Aluminum Sulfate Solution

Aluminum sulfate powder (manufactured by Asada Chemical Industry Co., Ltd., 17% by mass aluminum sulfate): 35 parts Deionized water: 1,965 parts An aqueous aluminum sulfate solution is prepared as a coagulant by charging the foregoing ingredients into a container and stirring and mixing the ingredients at 30° C. until no sediment remains.

Manufacture of Toner

The following ingredients are placed into a stirring vessel equipped with a thermometer, a pH meter, a stirrer, and a jacket and are stirred for 10 minutes.

Polyester Resin Particle Dispersion (A1): 635 parts

Colorant particle dispersion: 100 parts

Release agent particle dispersion: 115 parts

Deionized water: 200 parts

Anionic surfactant (Neogen RK, manufactured by DKS Co. Ltd., sodium dodecylbenzenesulfonate): 7.0 parts Next, 125 parts of the aqueous aluminum sulfate solution is gradually added to the mixture in the stirring vessel while the mixture is introduced through the bottom valve of the stirring vessel into a Cavitron CD1010 (manufactured by Eurotec Co., Ltd.) and is dispersed for 10 minutes. After the addition is complete, heating is started to increase the jacket temperature to 50° C. After 120 minutes, the particle size is measured with a Multisizer II (aperture diameter: 50 μm, manufactured by Beckman Coulter, Inc.). The volume average particle size is measured to be 5.0 μm.

Thereafter, 312 parts of additional Polyester Resin Particle Dispersion (A1) is charged, and the mixture is held for 30 minutes. Thereafter, the pH is adjusted to 9.5 by adding a 4% by mass aqueous sodium hydroxide solution to the stirring vessel, and the jacket temperature is increased to and held at 90° C. The aggregated particles are examined for their shape and surface condition every 30 minutes under a light microscope and a scanning electron microscope (FE-SEM). The coalescence of the particles is observed after four hours, and the resulting slurry is cooled to 40° C. The cooled slurry is sieved through a vibratory sieve with a sieve opening of 15 μm (KGC800, manufactured by Kowa Kogyosho Co., Ltd.) and is then filtered through a filter press (manufactured by Tokyo Engineering Co., Ltd.). Thereafter, the toner particles in the filter press are washed by passing deionized water through the toner particles in an amount that is ten times the amount of toner particles.

The washed toner particles are dried by cyclone collection with a loop-type flash dryer (FJD-2 flash jet dryer manufactured by Seishin Enterprise Co., Ltd.) to obtain toner particles.

To 100 parts of the resulting toner particles are added 1.0 part of hydrophobic silica (RY50, manufactured by Japan Aerosil Co., Ltd.) and 0.8 parts of hydrophobic titanium oxide (T805, manufactured by Japan Aerosil Co., Ltd.). The mixture is blended with a sample mill at 13,000 rpm for 30 seconds. Thereafter, the mixture is sieved through a vibratory sieve with a sieve opening of 45 μm to obtain a toner.

Preparation of Carrier

Mn—Mg—Sr-based ferrite particles (average particle size: 40 μm): 100 parts

Toluene: 14 parts

Cyclohexyl methacrylate/dimethylaminoethyl methacrylate copolymer (copolymerization mass ratio: 99:1, weight average molecular weight Mw: 80,000): 2.0 parts Carbon black (VXC72, manufactured by Cabot Corporation): 0.12 parts The foregoing ingredients excluding the ferrite particles and glass beads (diameter: 1 mm, the same amount as toluene) are stirred with a sand mill manufactured by Kansai Paint Co., Ltd. at 1,200 rpm for 30 minutes to obtain a solution for forming a resin coating layer. The solution for forming a resin coating layer and the ferrite particles are placed into a vacuum degassing kneader, and toluene is distilled and dried off under reduced pressure to form a carrier.

Preparation of Developer

To 500 parts of the carrier is added 40 parts of the toner. After the mixture is blended in a V-blender for 20 minute, aggregates are removed with a vibratory sieve with a sieve opening of 212 μm to obtain a developer.

Various Measurements

The acid value of the surface of the toner particles is measured in accordance with the "potentiometric titration method" specified in JIS K0070 (1992).

The acid value of the toner particles, the melt viscosity of the toner particles, the glass transition temperature of the toner particles, and the amount of each element (amounts of Na, S, and Al) in the toner particles of the developer (toner) of each example are measured by the methods described above.

The measurement results are summarized in Table 1.

Evaluations

The developer of each example is evaluated as follows. The results are summarized in Table 1.

Charge Stability Evaluation

A charge stability evaluation is performed as follows.

The toner and the carrier before the preparation of each developer are allowed to stand in a high-temperature, high-humidity atmosphere at 28° C. and 90% RH and in a low-temperature, low-humidity atmosphere at 10° C. and 115% RH for 24 hours. Thereafter, the toner and the carrier are weighed into a lidded glass bottle such that the toner concentration is 6% and are stirred with a Turbula mixer in each atmosphere to obtain a developer. The amount of charge on the toner of the stirred developer is measured at 25° C. and 55% RH with a TB200 manufactured by Toshiba Corporation. The difference in the amount of charge on the toner between the high-temperature, high-humidity environment and the low-temperature, low-humidity environment is determined and rated on the following scale:

A: The difference in the amount of charge on the toner is less than 5 μC/g.

B: The difference in the amount of charge on the toner is from 5 μC/g to less than 10 μC/g.

C: The difference in the amount of charge on the toner is 10 μC/g or more.

A and B are acceptable.

Fixed Image Strength (Crease) Evaluation

A fixed image strength evaluation is performed as follows.

Each developer is charged into a developing device of a modified DocuCentre Color 500 manufactured by Fuji Xerox Co., Ltd. (modified to perform fixing with an external fixing device with variable fixing temperature). This image-forming apparatus is used to form a solid image on color paper (J paper) manufactured by Fuji Xerox Co., Ltd. at a toner weight of 13.5 g/m$^2$. After the toner image is formed, the toner image is fixed with the external fixing device at a nip width of 6.5 mm and a fixing speed of 180 mm/sec.

The toner image is fixed at a constant fixing temperature of 130° C. A crease is made inwards substantially in the center of the solid area of the fixed image on the paper, and the fractured portion of the fixed image is wiped off with tissue paper. The width of the white line is measured and rated on the following rating scale:

A: The width of the white line is less than 0.1 mm

B: The width of the white line is from 0.1 mm to less than 0.2 mm

C: The width of the white line is from 0.2 mm to 0.3 mm

D: The width of the white line is from 0.3 mm to 0.4 mm

E: The width of the white line is from 0.4 mm to 0.8 mm

F: The width of the white line is more than 0.8 mm

Examples 2 to 11 and Comparative Examples 1 to 14

The conditions for the manufacture of the polyester resin particle dispersions and the toners of Examples 2 to 11 and Comparative Examples 1 to 14 are summarized in Table 2. Developers are prepared as in Example 1 except that the conditions are changed to those shown in Table 2.

In Table 2, the "pH adjustment" column shows the pH after adjustment by the addition of an aqueous sodium hydroxide solution during the manufacture of the toners.

TABLE 1

| | Acid value A of PE resin mg KOH/g | Acid value of surface of PE resin particles mg KOH/g | Acid value B of surface of toner particles mg KOH/g | B/A × 100 % | Melt viscosity of toner particles Pa · s | Glass transition temperature of toner particles ° C. | Amount of Na % | Amount of S % | Amount of Al % | Charge stability — | Fixed image strength — |
|---|---|---|---|---|---|---|---|---|---|---|---|
| Ex. 1 | 14.9 | 7.9 | 0.045 | 0.3 | 2,800 | 43 | 0.2 | 0.12 | 0.02 | B | B |
| Ex. 2 | 14.9 | 7.2 | 0.045 | 0.3 | 2,500 | 36 | 0.1 | 0.1 | 0.03 | B | A |
| Ex. 3 | 14.9 | 6.4 | 0.045 | 0.3 | 2,000 | 30 | 0.05 | 0.06 | 0.02 | B | D |
| Ex. 4 | 14.9 | 7.9 | 0.149 | 1.0 | 3,600 | 52 | 0.22 | 0.13 | 0.02 | A | E |
| Ex. 5 | 14.9 | 7.2 | 0.149 | 1.0 | 2,700 | 39 | 0.13 | 0.1 | 0.03 | A | A |
| Ex. 6 | 14.9 | 6.4 | 0.149 | 1.0 | 2,400 | 37 | 0.07 | 0.07 | 0.02 | A | C |
| Ex. 7 | 14.9 | 7.9 | 0.253 | 1.7 | 3,700 | 54 | 0.25 | 0.14 | 0.02 | B | E |

TABLE 1-continued

| | Acid value A of PE resin mg KOH/g | Acid value of surface of PE resin particles mg KOH/g | Acid value B of surface of toner particles mg KOH/g | B/A × 100 % | Melt viscosity of toner particles Pa · s | Glass transition temperature of toner particles ° C. | Amount of Na % | Amount of S % | Amount of Al % | Charge stability — | Fixed image strength — |
|---|---|---|---|---|---|---|---|---|---|---|---|
| Ex. 8 | 14.9 | 7.2 | 0.253 | 1.7 | 2,900 | 44 | 0.15 | 0.11 | 0.03 | B | A |
| Ex. 9 | 14.9 | 6.4 | 0.253 | 1.7 | 2,400 | 37 | 0.09 | 0.09 | 0.02 | B | C |
| Comp. Ex. 1 | 14.9 | 5.7 | 0.030 | 0.2 | 3,000 | 43 | 0.2 | 0.12 | 0.01 | C | A |
| Comp. Ex. 2 | 14.9 | 5.7 | 0.030 | 0.2 | 1,500 | 24 | 0.05 | 0.05 | 0.02 | C | F |
| Comp. Ex. 3 | 14.9 | 8.6 | 0.283 | 1.9 | 3,700 | 53 | 0.25 | 0.15 | 0.02 | C | F |
| Comp. Ex. 4 | 14.9 | 8.6 | 0.283 | 1.9 | 1,900 | 29 | 0.1 | 0.11 | 0.03 | C | F |
| Ex. 10 | 14.9 | 8.6 | 0.149 | 1.0 | 3,800 | 55 | 0.3 | 0.15 | 0.01 | A | E |
| Comp. Ex. 5 | 14.9 | 6.4 | 0.149 | 1.0 | 1,500 | 24 | 0.02 | 0.06 | 0.02 | A | F |
| Ex. 11 | 14.9 | 7.9 | 0.149 | 1.0 | 3,600 | 53 | 0.25 | 0.18 | 0.03 | A | E |
| Comp. Ex. 6 | 14.9 | 6.4 | 0.149 | 1.0 | 1,600 | 26 | 0.05 | 0.04 | 0.02 | A | F |
| Comp. Ex. 7 | 14.9 | 6.4 | 0.149 | 1.0 | 1,700 | 27 | 0.05 | 0.06 | 0.04 | A | F |
| Comp. Ex. 8 | 14.9 | 7.9 | 0.149 | 1.0 | 1,300 | 18 | 0.05 | 0.06 | 0.005 | A | F |
| Comp. Ex. 9 | 15.4 | 8.2 | 0.045 | 0.3 | 3,800 | 55 | 0.25 | 0.15 | 0.02 | C | E |
| Comp. Ex. 10 | 15.4 | 6.6 | 0.045 | 0.3 | 1,700 | 26 | 0.05 | 0.07 | 0.02 | C | F |
| Comp. Ex. 11 | 15.4 | 8.2 | 0.150 | 1.0 | 3,600 | 54 | 0.24 | 0.14 | 0.03 | C | E |
| Comp. Ex. 12 | 15.4 | 6.6 | 0.150 | 1.0 | 1,700 | 27 | 0.07 | 0.08 | 0.02 | C | F |
| Comp. Ex. 13 | 15.4 | 8.2 | 0.255 | 1.7 | 4,000 | 57 | 0.25 | 0.15 | 0.02 | C | F |
| Comp. Ex. 14 | 15.4 | 6.6 | 0.255 | 1.7 | 1,800 | 30 | 0.08 | 0.09 | 0.03 | C | E |

TABLE 2

| | Conditions for preparation of polyester resin particle dispersion | | | | Toner manufacture conditions | |
|---|---|---|---|---|---|---|
| | Polyester resin | | 20% by mass aqueous potassium hydroxide solution | Surfactant | Aqueous aluminum sulfate solution | pH |
| | Acid value | Amount supplied | Amount added | Amount added | Amount added | adjustment — |
| Ex. 1 | 14.9 | 200 parts | 10 parts | 50 parts | 125 | 9.5 |
| Ex. 2 | 14.9 | 200 parts | 10 parts | 50 parts | 125 | 9.0 |
| Ex. 3 | 14.9 | 200 parts | 10 parts | 50 parts | 125 | 8.5 |
| Ex. 4 | 14.9 | 200 parts | 15 parts | 50 parts | 125 | 9.5 |
| Ex. 5 | 14.9 | 200 parts | 15 parts | 50 parts | 125 | 9.0 |
| Ex. 6 | 14.9 | 200 parts | 15 parts | 50 parts | 125 | 8.5 |
| Ex. 7 | 14.9 | 200 parts | 20 parts | 50 parts | 125 | 9.5 |
| Ex. 8 | 14.9 | 200 parts | 20 parts | 50 parts | 125 | 9.0 |
| Ex. 9 | 14.9 | 200 parts | 20 parts | 50 parts | 125 | 8.5 |
| Comp. Ex. 1 | 14.9 | 200 parts | 8 parts | 50 parts | 125 | 9.5 |
| Comp. Ex. 2 | 14.9 | 200 parts | 8 parts | 50 parts | 125 | 8.5 |
| Comp. Ex. 3 | 14.9 | 200 parts | 25 parts | 50 parts | 125 | 9.5 |
| Comp. Ex. 4 | 14.9 | 200 parts | 25 parts | 50 parts | 125 | 8.5 |
| Ex. 10 | 14.9 | 200 parts | 25 parts | 45 parts | 125 | 8.0 |
| Comp. Ex. 5 | 14.9 | 200 parts | 15 parts | 50 parts | 125 | 8.0 |
| Ex. 11 | 14.9 | 200 parts | 15 parts | 70 parts | 125 | 9.5 |
| Comp. Ex. 6 | 14.9 | 200 parts | 15 parts | 20 parts | 125 | 8.0 |
| Comp. Ex. 7 | 14.9 | 200 parts | 15 parts | 50 parts | 180 | 8.5 |
| Comp. Ex. 8 | 14.9 | 200 parts | 15 parts | 50 parts | 90 | 8.5 |
| Comp. Ex. 9 | 15.4 | 200 parts | 10 parts | 50 parts | 125 | 9.5 |
| Comp. Ex. 10 | 15.4 | 200 parts | 10 parts | 50 parts | 125 | 8.5 |
| Comp. Ex. 11 | 15.4 | 200 parts | 15 parts | 50 parts | 125 | 9.5 |
| Comp. Ex. 12 | 15.4 | 200 parts | 15 parts | 50 parts | 125 | 8.5 |
| Comp. Ex. 13 | 15.4 | 200 parts | 20 parts | 50 parts | 125 | 9.5 |
| Comp. Ex. 14 | 15.4 | 200 parts | 20 parts | 50 parts | 125 | 8.5 |

The foregoing results demonstrate that the Examples exhibit a higher charge stability in a high-temperature, high-humidity environment and a higher fixed image strength than the Comparative Examples.

The foregoing description of the exemplary embodiment of the present disclosure has been provided for the purposes of illustration and description. It is not intended to be exhaustive or to limit the disclosure to the precise forms disclosed. Obviously, many modifications and variations will be apparent to practitioners skilled in the art. The embodiment was chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. An electrostatic-image developing toner comprising toner particles containing a polyester resin having an acid value of from 10 mg KOH/g to less than 15 mg KOH/g, wherein the toner particles have a surface with an acid value in a range from 0.3% to 1.7% of the acid value of the polyester resin, the toner particles have a melt viscosity of from 1,800 Pa·s to 3,800 Pa·s at 100° C., and the toner particles contain Na in an amount of from 0.05% by mass to 0.25% by mass based on a mass of the toner particles.

2. The electrostatic-image developing toner according to claim 1, wherein Na is present in an amount of from 0.10% by mass to 0.20% by mass based on the mass of the toner particles.

3. The electrostatic-image developing toner according to claim 1, wherein the toner particles contain S in an amount of from 0.06% by mass to 0.15% by mass based on a mass of the toner particles.

4. The electrostatic-image developing toner according to claim 1, wherein the toner particles contain Al in an amount of from 0.01% by mass to 0.03% by mass based on a mass of the toner particles.

5. The electrostatic-image developing toner according to claim 1, wherein the polyester resin has a weight average molecular weight (Mw) of from 5,000 to 1,000,000.

6. The electrostatic-image developing toner according to claim 1, wherein the polyester resin has a molecular weight distribution Mw/Mn of from 1.5 to 100.

7. The electrostatic-image developing toner according to claim 1, wherein the toner particles contain a release agent having a melting temperature of from 50° C. to 110° C.

8. The electrostatic-image developing toner according to claim 1, wherein the toner particles have an average circularity of from 0.94 to 1.00.

9. An electrostatic image developer comprising the electrostatic-image developing toner according to claim 1.

10. A toner cartridge attachable to and detachable from an image-forming apparatus, the toner cartridge containing the electrostatic-image developing toner according to claim 1.

11. An electrostatic-image developing toner comprising toner particles containing a polyester resin having an acid value of from 10 mg KOH/g to less than 15 mg KOH/g, wherein the toner particles have a surface with an acid value in a range from 0.3% to 1.7% of the acid value of the polyester resin, the toner particles have a glass transition temperature (Tg) of from 30° C. to 55° C., and the toner particles contain Na in an amount of from 0.05% by mass to 0.25% by mass based on a mass of the toner particles.

12. The electrostatic-image developing toner according to claim 11, wherein Na is present in an amount of from 0.10% by mass to 0.20% by mass based on the mass of the toner particles.

13. The electrostatic-image developing toner according to claim 11, wherein the toner particles contain S in an amount of from 0.06% by mass to 0.15% by mass based on a mass of the toner particles.

14. The electrostatic-image developing toner according to claim 11, wherein the toner particles contain Al in an amount of from 0.01% by mass to 0.03% by mass based on a mass of the toner particles.

15. The electrostatic-image developing toner according to claim 11, wherein the polyester resin has a weight average molecular weight (Mw) of from 5,000 to 1,000,000.

16. The electrostatic-image developing toner according to claim 11, wherein the polyester resin has a molecular weight distribution Mw/Mn of from 1.5 to 100.

17. The electrostatic-image developing toner according to claim 11, wherein the toner particles contain a release agent having a melting temperature of from 50° C. to 110° C.

18. The electrostatic-image developing toner according to claim 11, wherein the toner particles have an average circularity of from 0.94 to 1.00.

* * * * *